US010908534B2

(12) United States Patent
Morimoto

(10) Patent No.: US 10,908,534 B2
(45) Date of Patent: Feb. 2, 2021

(54) DEVELOPING APPARATUS

(71) Applicant: Hewlett-Packard Development Company, L.P., Spring, TX (US)

(72) Inventor: Kiyofumi Morimoto, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/647,234

(22) PCT Filed: Oct. 4, 2018

(86) PCT No.: PCT/KR2018/011717
§ 371 (c)(1),
(2) Date: Mar. 13, 2020

(87) PCT Pub. No.: WO2019/088466
PCT Pub. Date: May 9, 2019

(65) Prior Publication Data

US 2020/0272072 A1 Aug. 27, 2020

(30) Foreign Application Priority Data

Oct. 31, 2017 (JP) ..... 2017-210447

(51) Int. Cl.
*G03G 15/08* (2006.01)
*G03G 21/10* (2006.01)
*G03G 21/20* (2006.01)

(52) U.S. Cl.
CPC ..... *G03G 15/0893* (2013.01); *G03G 21/105* (2013.01); *G03G 21/206* (2013.01)

(58) Field of Classification Search
None
See application file for complete search history.

(56) References Cited

U.S. PATENT DOCUMENTS

| | | | | |
|---|---|---|---|---|
| 7,920,804 | B2 * | 4/2011 | Mori | G03G 21/206 399/94 |
| 2002/0191982 | A1 * | 12/2002 | Tsukamoto | G03G 15/104 399/94 |
| 2004/0114971 | A1 * | 6/2004 | Sakai | G03G 15/0812 399/284 |
| 2005/0100360 | A1 | 5/2005 | Koshimura et al. | |
| 2005/0152713 | A1 | 7/2005 | Maeda et al. | |
| 2014/0294448 | A1 * | 10/2014 | Anan | G03G 21/1821 399/258 |
| 2014/0301746 | A1 * | 10/2014 | Murata | G03G 15/0879 399/27 |
| 2015/0220021 | A1 | 8/2015 | Leemhuis et al. | |

FOREIGN PATENT DOCUMENTS

| | | | |
|---|---|---|---|
| JP | 2007-304443 | A | 11/2007 |
| JP | 2013-097252 | A | 5/2013 |
| JP | 2014-228666 | A | 12/2014 |

* cited by examiner

*Primary Examiner* — Sevan A Aydin
(74) *Attorney, Agent, or Firm* — Jefferson IP Law, LLP

(57) ABSTRACT

A developing device includes a casing containing a housing chamber and having a developer outlet port to discharge excess developer from the housing chamber. A developer roll is disposed in the housing chamber, to carry a developer. The developing device includes an airflow passage to allow air to flow in from the housing chamber when the developer roll rotates. The developing device further includes a radiation member located adjacent the housing chamber to transfer heat to the air flowing through the airflow passage.

20 Claims, 8 Drawing Sheets

[Fig. 1]
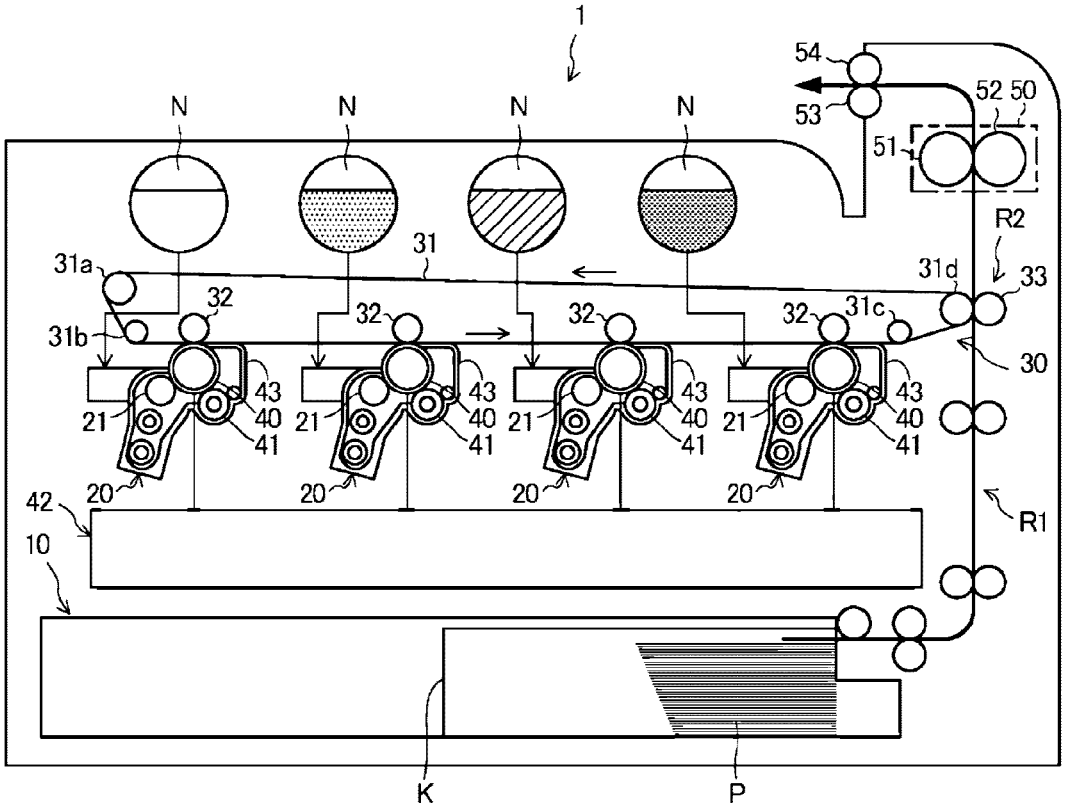

[Fig. 2]
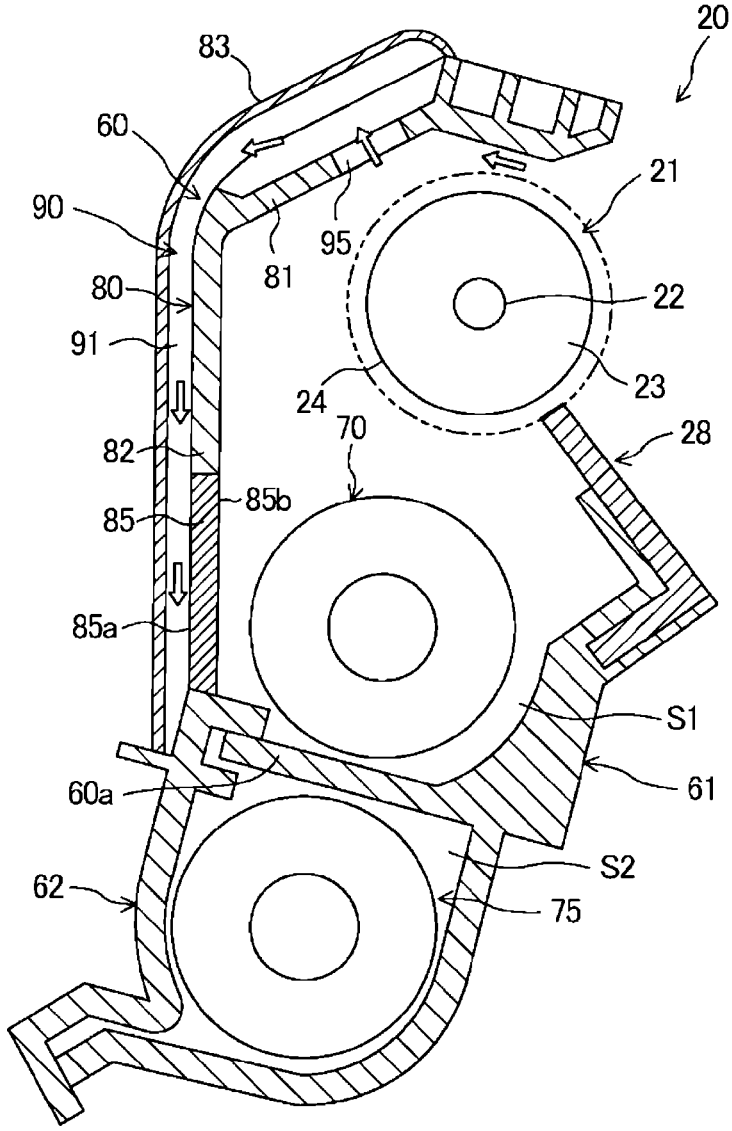

[Fig. 3]
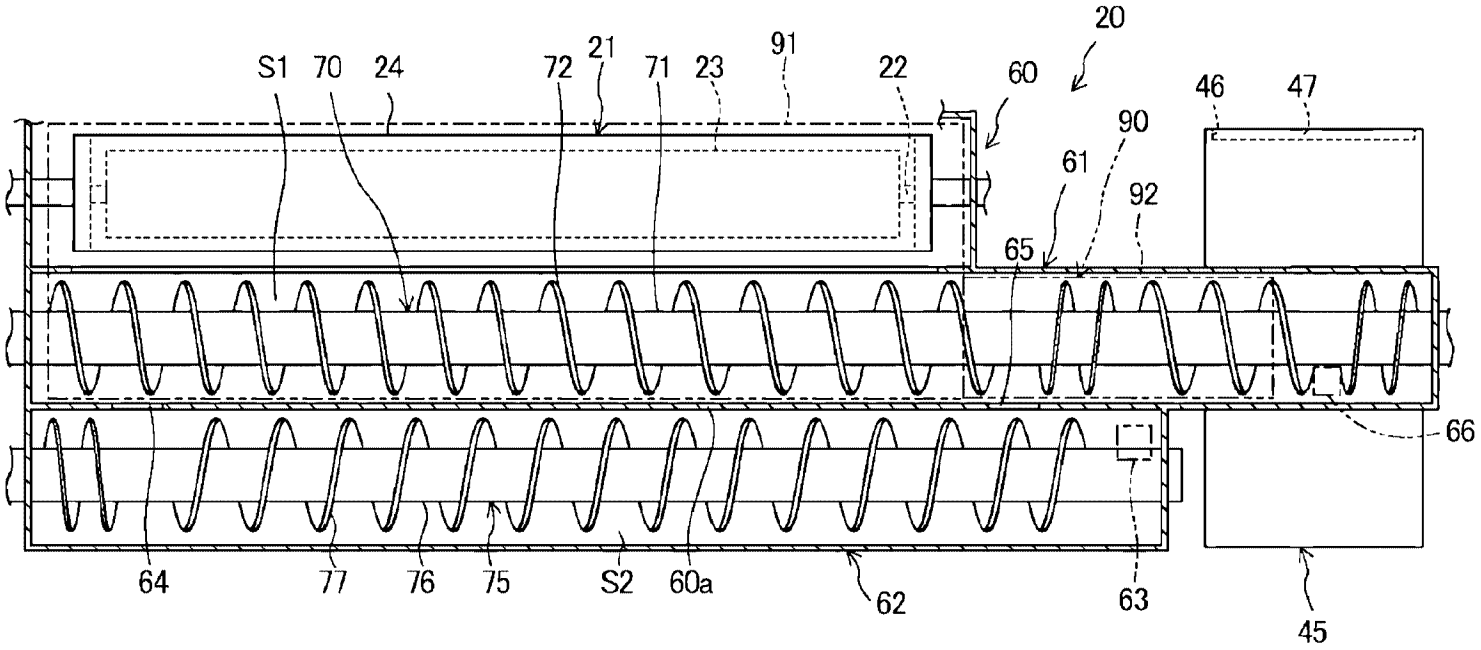

[Fig. 4]
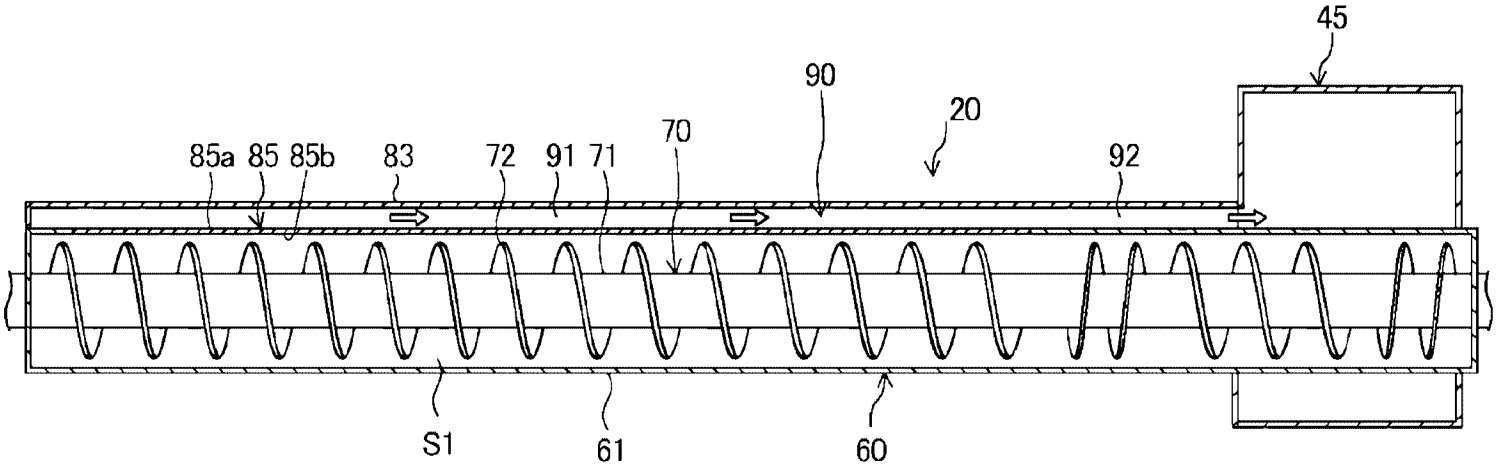

[Fig. 5]
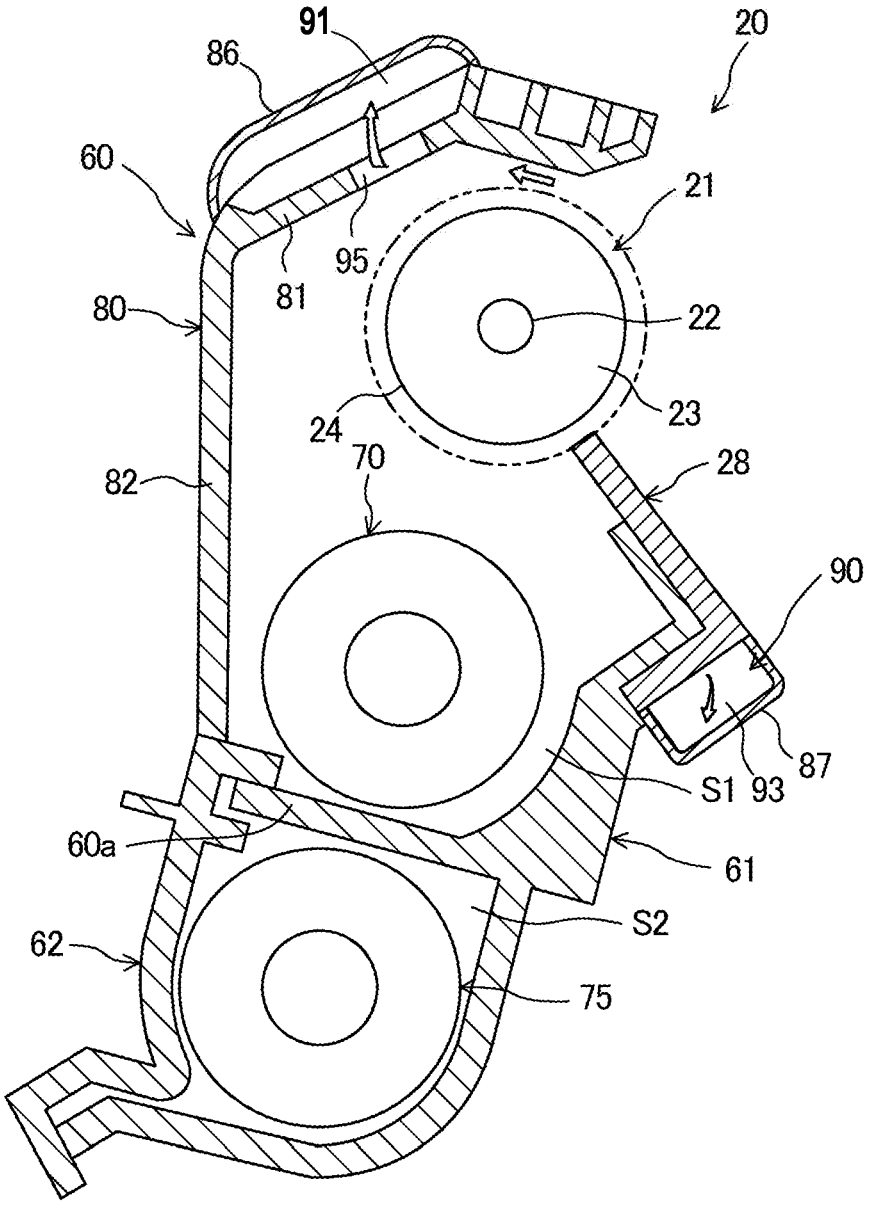

[Fig. 6]

| Printing speed [rpm] | Subject | Airflow passage | Radiation member | Thermal conductiviey [W/mK] | Temperature [° C] | Toner scattering amount [mg] | Developer discharge amount [mg] |
|---|---|---|---|---|---|---|---|
| 70 | Example 1 | YES | Aluminum | 20.4 | 45.5 | 7.3 | 9.8 |
| | Example 2 | YES | SUS (blade) | 16.7 | 46 | 8.5 | 11.5 |
| | Comparative example 1 | NO | NO | - | 50.5 | 32 | 68.2 |
| | Comparative example 2 | YES | NO | 0.2 | 49 | 6.8 | 10.3 |
| 80 | Example 1 | YES | Aluminum | 20.4 | 47.7 | 15.2 | 16.8 |
| | Example 2 | YES | SUS (blade) | 16.7 | 48.9 | 14.8 | 15.2 |
| | Comparative example 1 | NO | NO | - | 54.2 | 73.9 | 103.9 |
| | Comparative example 2 | YES | NO | 0.2 | 53.3 | 18.8 | 14.9 |

[Fig. 7]
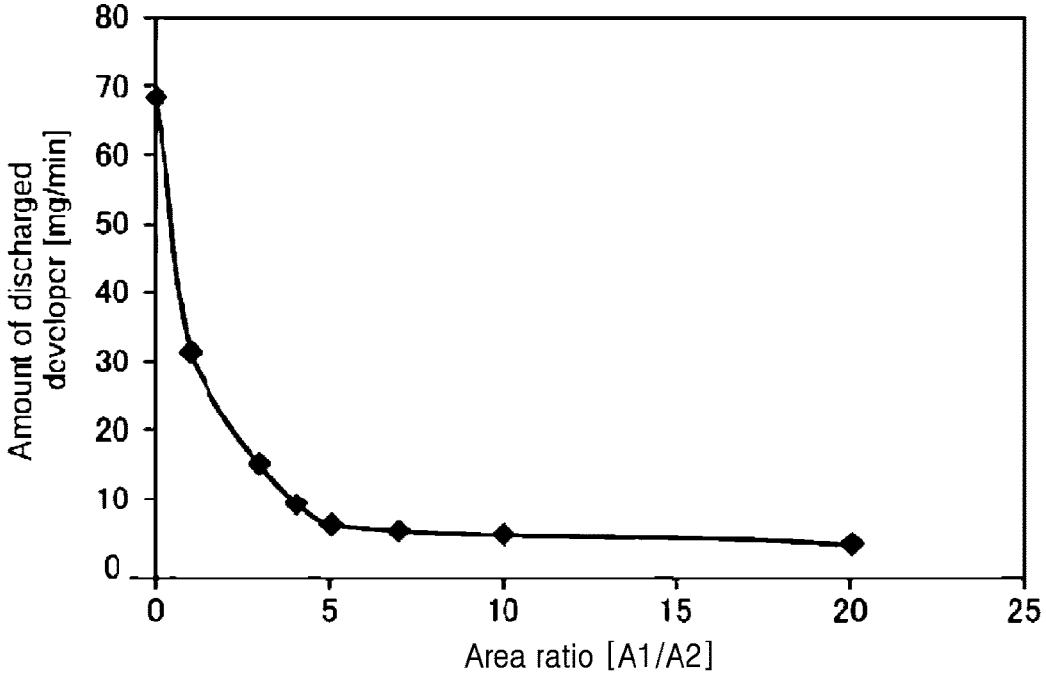
[Fig. 8]
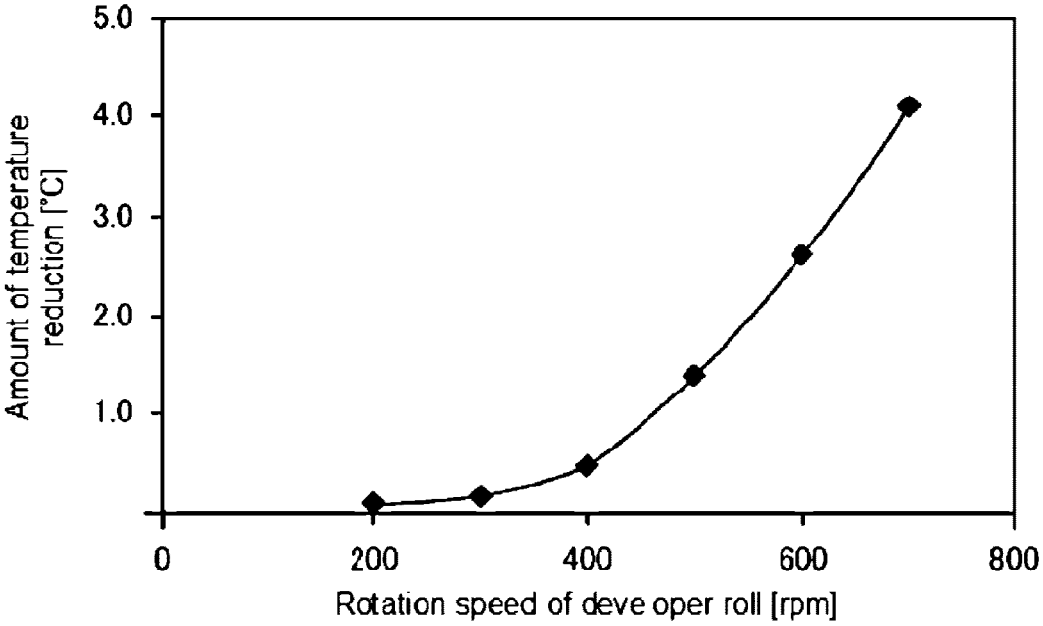

[Fig. 9]
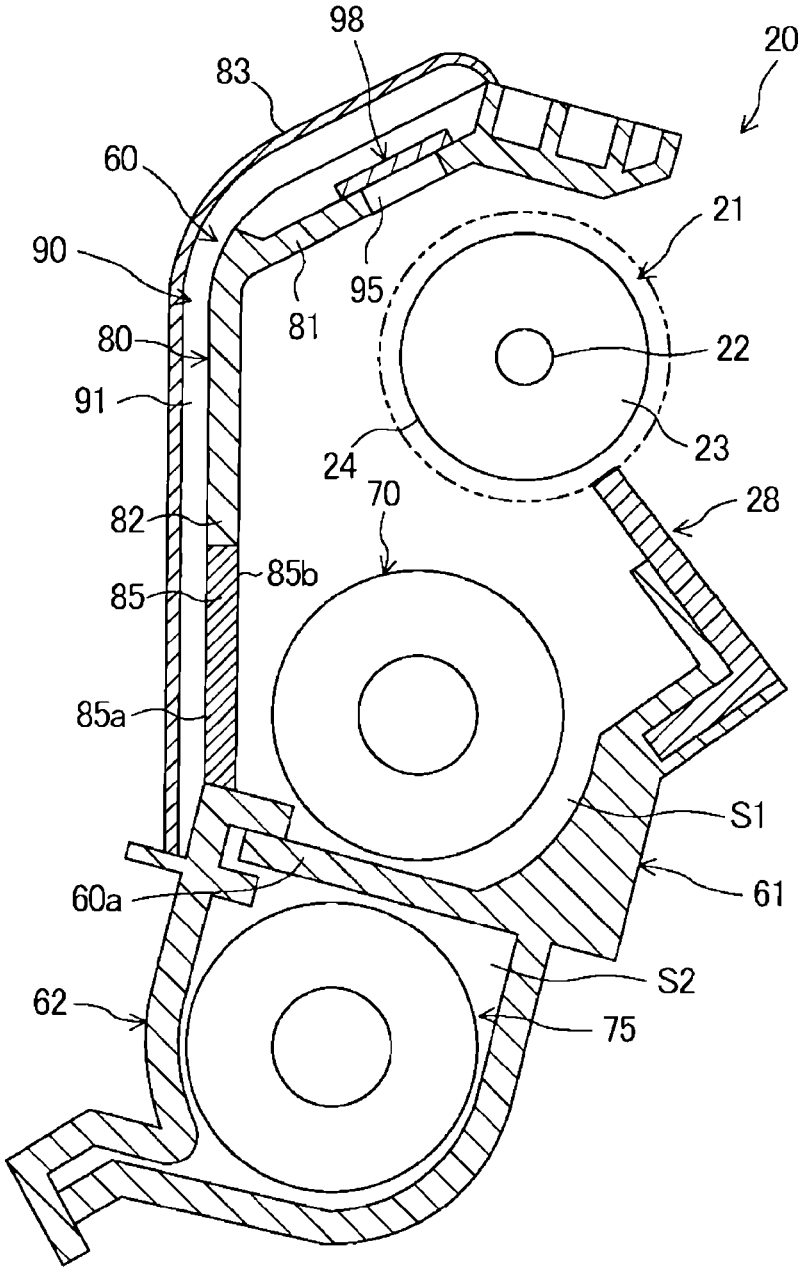

DEVELOPING APPARATUS

BACKGROUND ART

In a developing device equipped with a developer roll, an increase in the temperature of a developer may cause the fixation of toner to a developer layer regulating member, the production of aggregates of toner and carrier, and the reduction in charge amount, thereby affecting image quality.

In some developing devices, a shaft of a developer roll or a transfer member is extended externally to a housing, and the extended portion is cooled by a cooling member (such as a Peltier device). With this, the developer roll or the transfer member can be cooled and, as a consequence, an increase in the temperature of the developer can be suppressed.

BRIEF DESCRIPTION OF DRAWINGS

FIG. 1 is a schematic structural diagram showing an overall structure of an example image forming apparatus.

FIG. 2 is a schematic vertical cross sectional view which shows the inside of an example developing device of the image forming apparatus illustrated in FIG. 1, from a lateral side, in which an air flow is schematically shown by white blank arrows.

FIG. 3 is a schematic longitudinal cross sectional view which shows the inside of the example developing device illustrated in FIG. 2, from a front side.

FIG. 4 is a schematic longitudinal cross sectional view which shows the inside of the example developing device illustrated in FIG. 1, from an upper side.

FIG. 5 is a schematic vertical cross sectional view of another example developing device.

FIG. 6 shows results of performance tests on example developing devices.

FIG. 7 is a graph showing a relation between area ratio and developer discharge amount, according to an example.

FIG. 8 is a graph showing a relation between rotation speed of the developer roll and temperature reduction due to the airflow passage, according to an example.

FIG. 9 is a schematic vertical cross sectional view of another example developing device.

MODE FOR THE INVENTION

In the following description, with reference to the drawings, the same reference numbers are assigned to the same components or to similar components having the same function, and overlapping description is omitted.

Overall Structure of Image Forming Apparatus

A schematic construction of an example image forming apparatus 1 will be described. As shown in FIG. 1, the image forming apparatus 1 is an apparatus to form color images using magenta, yellow, cyan and block colors. The image forming apparatus 1 forms an image on a paper sheet (recording medium) P.

The example image forming apparatus 1 is provided with a recording medium conveyance unit 10 for conveying a paper sheet P, developing devices 20 for developing an electrostatic latent image, a transfer unit 30 for secondarily transferring the toner image to the paper sheet P, photosensitive drums 40 that are electrostatic latent image carriers, on circumferential surfaces of which the image is formed, and a fixation unit 50 for fixing the toner image onto the paper sheet P. The image forming apparatus 1 is attachably and detachably provided with a waste toner box 45 (not shown in FIG. 1) for collecting waste toner.

The recording medium conveyance unit 10 conveys a paper sheet P to be formed with an image along a conveyance path R1. The paper sheet P is stacked and contained in a cassette K, picked up by a paper feed roller and conveyed. The recording medium conveyance unit 10 conveys the paper sheet P in such a timing that the paper sheet P arrives at a secondary transfer region R2 through the conveyance path R1 when a toner image to be transferred to the paper sheet P arrives at the secondary transfer region R2.

Four developing devices 20 are provided for the respective colors. Each of the developing devices 20 is provided with a developer roll 21 for carrying toner to the photosensitive drum 40. In the developing device 20, toner and carrier are adjusted to have a suitable mixing ratio. In the developing device 20, the toner is uniformly dispersed to prepare a developer imparted with an optimal amount of charge. The developer agent is carried by the developer roll 21. As the developer roll 21 rotates to carry the developer agent to a region facing the photosensitive drum 40, toner is moved out of the developer agent carried on the developer roll 21 and onto an electrostatic latent image formed on a circumferential surface of the photosensitive drum 40 to develop the electrostatic latent image.

The transfer unit 30 carries the toner image formed with the developing device 20 to the secondary transfer region R2 where the toner image is secondary transferred to the paper sheet P. The transfer unit 30 is provided with a transfer belt 31, support rollers 31*a*, 31*b*, 31*c* and 31*d* for supporting the transfer belt 31, primary transfer rollers 32 for holding the transfer belt 31 with the photosensitive drums 40, and a secondary transfer roller 33 for holding the transfer belt with the support roller 31*d*.

The transfer belt 31 is an endless belt circularly moved by the support rollers 31*a*, 31*b*, 31*c* and 31*d*. The primary transfer rollers 32 are disposed to press the photosensitive drums 40 from the inside of the transfer belt 31. The secondary transfer roller 33 is disposed to press the support roller 31*d* from the outside of the transfer belt 31.

Four photosensitive drums 40 are provided for the respective colors. Each of the photosensitive drums 40 is provided along the direction of movement of the transfer belt 31. Around the circumference of the photosensitive drum 40, the developing device 20, a charge roller 41, an exposure unit 42 and a cleaning unit 43 are arranged.

The charge roller 41 is a charge means for uniformly charging the surface of the photosensitive drum 40 at a predetermined potential. The charge roller 41 is moved to follow the rotation of the photosensitive drum 40. The exposure unit 42 exposes the surface of the photosensitive drum 40 charged by the charge roller 41 in accordance with an image to be formed on the paper sheet P. The potential of portions of the surface of the photosensitive drum 40 exposed by the exposure unit 42 is thereby changed to form an electrostatic latent image. Each of the four developing devices 20 uses the toner supplied from a toner tank N provided opposite to the developing device 20 to develop the electrostatic latent image formed on the photosensitive drum 40 and creates a toner image. The toner tanks N are respectively filled with magenta, yellow, cyan and black toners. The cleaning unit 43 recovers the toner remaining on the photosensitive drum 40 after the toner image formed on the photosensitive drum 40 has been primarily transferred onto the transfer belt 31.

The fixation unit 50 adheres and fixates onto the paper sheet P the toner image that has been secondarily transferred from the transfer belt 31 to the paper sheet P. The fixation unit 50 is provided with a heater roller 51 for heating the paper sheet P and a pressure roller 52 for pressing the heater roller 51. The heater roller 51 and the pressure roller 52 are formed in cylindrical shapes, and the heater roller 51 is internally provided with a heat source such as a halogen lamp. A contact area called a fixation nip is formed between the heater roller 51 and the pressure roller 52, and the toner image is fused and fixated onto the paper sheet P while passing the paper sheet P through the fixation nip. After the toner image has been secondarily transferred onto the paper sheet P, the toner remaining on the transfer belt 31 is recovered by a belt cleaning device.

Further, the image forming apparatus 1 is provided with discharge rollers 53 and 54 for discharging the paper sheet P with the fixated toner image to the outside of the apparatus.

Printing Operation

The printing operation of the image forming apparatus 1 will be described. When an image signal of a recording image is input to the image forming apparatus 1, the image forming apparatus rotates the paper feed roller to pick up and convey a paper sheet P stacked in the cassette K. Then, based on the received image signal, the surface of the photosensitive drum 40 is uniformly charged at a predetermined potential by the charge roller 41 (charging). After that, an electrostatic latent image is formed by irradiating laser light onto the surface of the photosensitive drum 40 with the exposure unit 42 (exposing).

In the developing device 20, the electrostatic latent image is developed to form a toner image (developing). Thus formed toner image is primarily transferred from the photosensitive drum 40 to the transfer belt 31 in the region at which the photosensitive drum 40 faces the transfer belt 31 (transferring). The toner images formed on the four photosensitive drums 40 are successively overlaid to form a single overlaid toner image on the transfer belt 31. Then, the overlaid toner image is secondarily transferred onto the paper sheet P conveyed from the recording medium conveyance unit 10 in the secondary transfer region R2 at which the support roller 31*d* faces the secondary transfer roller 33.

The paper sheet P, with the secondarily transferred overlaid toner image, is conveyed to the fixation unit 50. The overlaid toner image is fused and fixated onto the paper sheet P while the paper sheet P is made to pass under heat and pressure between the heater roller 51 and the pressure roller 52 (fixating). After that, the paper sheet P is discharged to the outside of the image forming apparatus 1 by the discharge rollers 53 and 54.

Developing Device

An example developing device includes a casing, a developer roll disposed in a housing chamber in the casing for carrying a developer, and a layer thickness regulating member for making a thickness of the developer attached to the developer roll uniform, the casing being formed with a developer outlet port for discharging excess developer from the housing chamber, wherein the developing device includes an airflow passage and a radiation member, the airflow passage is adapted such that air flows in from the housing chamber as the developer roll rotates, and the radiation member transfers heat to the air flowing through the airflow passage and faces the housing chamber. In some examples, the radiation member is located adjacent the housing chamber to transfer heat from the housing chamber to the airflow passage.

Accordingly, air flows into the housing chamber as the developer roll rotates, and this air flows through the airflow passage. When the air in the airflow passage passes over the radiation member, the heat of the developer is transferred via the radiation member to the air flowing through the airflow passage. In other words, the air flowing through the airflow passage is used for cooling the developer. Consequently, an increase in the temperature of the developer can be suppressed in the housing chamber.

In some examples, the radiation member is also used as the layer thickness regulating member.

Accordingly, the air flowing through the airflow passage passes over the layer thickness regulating member which also functions as the radiation member. Consequently, the heat from the layer thickness regulating member can be transferred to the air flowing through the airflow passage, and the layer thickness regulating member can be cooled thereby.

In some examples, the radiation member has a thermal conductivity of 10 W/mK or more.

Accordingly, when the thermal conductivity of the radiation member is 10 W/mK or more, the effect of cooling the developer with the radiation member can be enhanced.

In some examples, the minimum passage cross sectional area (or the minimum cross sectional area) of the airflow passage is five times or more the opening area of the developer outlet port.

Accordingly, when the minimum passage cross sectional area of the airflow passage is five times or more the opening area of the developer outlet port, air can flow from the housing chamber into the airflow passage more easily. As a result, the effect of cooling the developer with the radiation member can be enhanced. On the other hand, when a flow rate of air into the airflow passage increases, a flow rate of air to the developer outlet port decreases correspondingly. Therefore, excessive discharge of the developer from the housing chamber to the developer outlet port can be suppressed.

In some examples, the rotation speed of the developer roll is 500 rpm or more.

In some examples, the flow rate of air introduced into the flow passage increases. As a result, the effect of cooling the developer with the radiation member can be enhanced.

In some examples, a shutter mechanism is provided in the airflow passage.

Thus, the airflow passage can be opened or closed by the shutter mechanism. Accordingly, during transportation of the developing device, for example, the shutter mechanism in a closed state can suppress leakage of the developer from the housing chamber to the outside of the casing through airflow passage.

In some examples, a waste toner box is provided for collecting developer discharged from the developer outlet port, and an outlet end of the flow passage is connected to the waste toner box.

Accordingly, air flowing through the airflow passage is directed toward the waste toner box. As a result, developer entrained in the air flowing through the airflow passage can be collected in the waste toner box.

In some examples, the waste toner box is formed with an air vent, and the air vent is provided with a filter.

Accordingly, the air directed toward the waste toner box through the airflow passage is discharged to the outside of the waste toner box through the air vent. This prevents the inner pressure of the housing chamber from increasing, and the scattering of the toner from the housing chamber can be suppressed. As the air vent is equipped with the filter, developer entrained in the air passing through the air vent can be captured by the filter. As a result, leakage of the developer from the waste toner box to the outside, together with the air, can be suppressed.

An example developing device can suppress an increase in developer temperature without giving rise to complication of the structure of the apparatus. Accordingly, the example developing device can inhibit an increase in developer temperature with a simple structure using a minimal number of components, and thus without having to resort to an unnecessarily complex structure.

A detailed structure of an example developing device 20 will now be described with reference to FIG. 2 to FIG. 4.

The example developing device 20 includes a casing 60, a developer roll 21, a blade 28, a first conveyance member 70 and a second conveyance member 75.

Casing

The casing 60 is formed as a laterally long container. The casing 60 has a partition 60*a* that separates the inner space vertically. In the casing 60, a first housing chamber S1 is formed above the partition 60*a* and a second housing chamber S2 is formed below the partition 60*a*. In the first housing chamber S1, the developer roll 21 and the first conveyance member 70 are disposed. In the second housing chamber S2, the second conveyance member 75 is disposed. In the casing 60, the part in which the first conveyance member 70 is disposed constitutes a first casing part 61 and the part in which the second conveyance member 75 is disposed constitutes a second casing part 62.

As shown in FIG. 3, the casing 60 is formed with a developer inlet port 63, a first opening 64, a second opening 65, and a developer outlet port 66. For example, the first opening 64 is formed in the vicinity of one longitudinal end of the casing 60. The developer inlet port 63, the second opening 65 and the developer outlet port 66 are formed in the vicinity of the other longitudinal end of the casing 60.

The developer inlet port 63 is formed in the second casing part 62. The developer inlet port 63 is an opening for transferring a developer supplied from the toner tank N to the second housing chamber S2. Note that the developer contains a magnetic carrier and a non-magnetic toner.

The first opening 64 is formed in the partition 60*a*. The first opening 64 communicates between the first housing chamber S1 and the second housing chamber S2. The first opening 64 is an opening for transferring the developer carried by the second conveyance member 75 to the first housing chamber S1.

The second opening 65 is formed in the partition 60*a*. The second opening 65 is disposed between the first opening 64 and the developer outlet port 66. The second opening 65 communicates between the first housing chamber S1 and the second housing chamber S2. The second opening 65 is an opening for transferring the developer carried by the first conveyance member 70 to the second housing chamber S2.

The developer outlet port 66 is formed in the first casing part 61. The developer outlet port 66 is an opening for transferring excess developer from the first housing chamber S1 to the waste toner box 45.

Developer Roll

The developer roll 21 is a developer carrier for supplying toner to an electrostatic latent image formed on a circumferential surface of the photosensitive drum 40. The developer roll 21 is disposed in an upper part of the first housing chamber S1 to face the photosensitive drum 40. As shown in FIG. 2, the developer roll 21 includes a shaft 22, a magnetic part 23, and a developer sleeve 24.

The shaft 22 extends horizontally along the longitudinal direction of the casing 60. The ends of the shaft 22 are fixed/supported to the casing 60.

The magnetic part 23 is fixed around the shaft 22. The magnetic part 23 is a cylindrical member having a plurality of magnetic poles. The magnetic part 23 has different magnetic poles disposed alternately in a region to face the photosensitive drum 40. The magnetic part 23 conveys the developer by magnetic forces on the circumferential surface of the developer sleeve 24. The magnetic part 23 forms strands of a magnetic brush of the developer and brings the magnetic brush into contact with or close to the electrostatic latent image on the photosensitive drum 40.

The developer sleeve 24 is a tubular member composed of a non-magnetic metal. The developer sleeve 24 may be formed in a cylindrical shape. The developer sleeve 24 extends horizontally to be coaxial with the shaft 22 and the magnetic part 23. The developer sleeve 24 is rotatably supported by the casing 60. The developer sleeve 24 is rotationally driven by a driving mechanism which is not shown.

Blade

The blade 28 is a layer thickness regulating member for making the developer attached to the outer circumferential surface of the developer sleeve 24 into a layer having a uniform thickness. Provided that the position at which the developer sleeve 24 faces the photosensitive drum 40 is a reference, the blade 28 is disposed upstream of the direction of rotation of the developer sleeve 24. The blade 28 is formed of a metal material such as stainless steel.

First Conveyance Member

The first conveyance member 70 stirs and mixes the developer in the first housing chamber S1, and it also conveys the developer. The developer stirred and mixed by the first conveyance member 70 is supplied to the developer roll 21. Further, the developer conveyed by the first conveyance member 70 is returned to the first housing chamber S1 through the second opening 65.

The first conveyance member 70 includes a first support shaft 71 and a first conveyor vane 72. The first support shaft 71 extends horizontally along the partition 60*a*. The first support shaft 71 is rotatably supported by bearings (not shown). The first conveyor vane 72 is formed on the outer circumferential surface of the first support shaft 71. The first conveyor vane 72 has spiral sloping surfaces disposed along the axial direction of the first support shaft 71. The first conveyor vane 72 conveys the developer (forwardly) from the side of the first opening 64 toward the side of the second opening 65.

Second Conveyance Member

The second conveyance member 75 stirs and mixes the developer in the second housing chamber S2, and it also conveys the developer. The developer stirred and mixed by the second conveyance member 75 is supplied to the first housing chamber S1 through the first opening 64.

The second conveyance member 75 includes a second support shaft 76 and a second conveyor vane 77. The second support shaft 76 extends horizontally along the partition 60*a*. The second support shaft 76 is rotatably supported by bearings (not shown). The second conveyor vane 77 is formed on the outer circumferential surface of the second support shaft 76. The second conveyor vane 77 has spiral sloping surfaces disposed along the axial direction of the second support shaft 76. The second conveyor vane 77 conveys the developer from the second opening 65 toward the first opening 64.

Cooling Structure for Developer Roll

In the developing device 20, the temperature of the developer increases as the developer roll 21 rotates. At a position where the blade 28 and the developer sleeve 24 are proximate, heat accumulates as a result of contact between the developer and the blade. In particular, as the developer roll 21 rotates at a faster speed to keep up with a high-speed printing operation, increase in the temperature of the developer is exacerbated. Such increase in the temperature of the developer causes the fixation of toner to the blade 28, the production of aggregates of toner and carrier, and the reduction in charge amount, thereby leading to image quality degradation. In view of this, the present example adopts a structure in which the developer is cooled by an airflow associated with the rotation of the developer roll 21. This cooling structure will be described with reference to FIG. 2 to FIG. 4.

As shown in FIG. 2, the first casing part 61 is provided widthwise with a side wall 80 on a side (hereinafter "front side") opposite to the blade 28. The side wall 80 includes an upper side wall 81 and a lower side wall 82. The upper side wall 81 is positioned above the axis of the developer roll 21 and sloped to face an upper part of the developer roll 21. The lower side wall 82 is disposed substantially vertically upright to face a lower part of the developer roll 21 and the first conveyance member 70.

The upper side wall 81 is formed with an air introduction port 95. The air introduction port is a laterally long opening extending in the longitudinal direction of the first casing part 61.

A cover member 83 is attached to the first casing part 61 to cover the front surface of the side wall 80. The cover member 83 is of a bent shape to fit along the upper side wall 81 and the lower side wall. The cover member 83 extends in the longitudinal direction of the first casing part 61 to cover the air introduction port 95 entirely. The cover member 83 is separated from the side wall 80 to have a predetermined spacing with the side wall 80. A first flow passage 91 for flowing air is formed between the cover member 83 and the side wall 80. The inlet side of the first flow passage 91 communicates with the first housing chamber S1 through an air inlet port 95.

As schematically shown in FIG. 3, the first flow passage 91 extends in the longitudinal direction of the side wall 80 so as to overlap widthwise with the developer roll 21 and the first conveyor vane 72 of the first conveyance member 70. As shown in the figure, a laterally long second flow passage 92 is formed between the front side of the side wall 80 and the cover member 83. An inflow end of the second flow passage 92 is connected to the first flow passage 91. An outflow end of the second flow passage 92 is connected to the waste toner box 45.

The air introduction port 95, the first flow passage 91 and the second flow passage 92 may constitute an airflow passage 90 for cooling the developer.

The developing device 20 is provided with a radiation member 85 facing the housing chamber (the first housing chamber S1, for example) for transferring heat to the air flowing through the airflow passage 90. The radiation member 85 is attached to an opening formed in the side wall 80 (the lower side wall, for example) of the casing 60. The radiation member 85 extends horizontally across the entire longitudinal region of the first flow passage 91.

The radiation member 85 is composed of a material having a high thermal conductivity. For example, the radiation member 85 may be composed of an aluminum material. The thermal conductivity of the radiation member 85 may be 10 W/mK or more. A first surface 85*a* on the front side of the radiation member 85 is exposed to the first flow passage 91. A second surface 85*b* on the rear side of the radiation member 85 is exposed to the first housing chamber S1. The radiation member 85 absorbs heat from the developer in the first housing chamber S1 and/or other component devices (such as the developer roll 21, the blade 28 and the first conveyance member 70), and radiates heat to the air flowing through the airflow passage 90.

Waste Toner Box

As schematically shown in FIG. 3 and FIG. 4, the developing device 20 is provided with the waste toner box 45. The waste toner box 45 is a half-sealed container separate from the casing 60. The waste toner box 45 communicates with the aforementioned developer outlet port 66. The waste toner box 45 communicates with the aforementioned airflow passage 90. As shown in FIG. 3, the waste toner box 45 is formed with an air vent 46 at its upper end. The air flowing into the waste toner box 45 is discharged to the outside of the waste toner box 45 through the air vent 46.

A filter 47 is attached to the air vent 46. The filter 47 captures the developer entrained in the air discharged from the air vent 46.

Cooling Operation

As the developer roll 21 is driven and rotated by the driving mechanism, air is drawn from the outside of the casing 60 into the first housing chamber S1. This air is transferred by the developer roll 21 rotating at a high speed of 500 rpm or more, and enters the air introduction port 95. The air entered into the air introduction port 95 flows through the first flow passage 91. The air flowing through the first flow passage 91 passes across the radiation member 85. As a result, heat in the first housing chamber S1 is transferred through the radiation member 85 to the air flowing through the first flow passage 91. Consequently, cooling is effected to the developer in the first housing chamber S1 and at the position where the blade 28 and the developer roll 21 are proximate.

The air in the first flow passage 91 flows through the second flow passage 92 into the waste toner box 45. The air transferred to the waste toner box 45 is discharged to the outside of the waste toner box 45 via the air vent 46. The developer entrained in the air is then captured by the filter 47.

With reference to FIG. 2, an airflow caused by the rotation of the developer roll 21 may be introduced into the airflow passage 90, so that the inside of the first housing chamber S1 can be cooled by the air flowing through the airflow passage 90. Accordingly, increase in the temperature of the developer can be suppressed in the first housing chamber S1 without having to provide a separate air blower or a cooling device.

The air flown through the airflow passage 90 is discharged to the outside, via the waste toner box 45. Consequently, increase in the inner pressure of the first housing chamber S1, which may accompany the rotation of the developer roll 21, can be suppressed. As a result, scattering of the toner attributable to increase in the inner pressure of the casing 60 can be suppressed.

Further, when the airflow caused by the rotation of the developer roll 21 is transferred to the airflow passage 90 as described above, the amount of air discharged from the developer outlet port 66 can be reduced. Accordingly, the amount of the developer carried away with the air to the developer outlet port 66 can be reduced.

The air within the waste toner box 45 is discharged to the outside of the waste toner box 45 after passing through the filter 47. Accordingly, leakage of the developer from within the waste toner box 45 to the outside can be suppressed.

In the example shown in FIG. 5, a first cover member 86 is attached to the front side of the air introduction port 95. The first flow passage 91 is formed inside the first cover member 86. Further, a second cover member 87 is provided to the rear side of a base of the blade 28. The second cover member 87 horizontally extends longitudinally end-to-end of the blade 28. A laterally long third flow passage 93 is formed between the second cover member 87 and the blade 28. The first flow passage 91 and the third flow passage 93 communicate with each other through an intermediate flow passage (not shown). An outflow end of the third flow passage 93 is connected to the waste toner box 45 similar to that of the example shown in FIGS. 2 to 4.

Still with reference to FIG. 5, the air introduction port 95, the first flow passage 91 and the third flow passage 93 constitute the airflow passage 90 for cooling the developer.

The blade 28 also functions as a radiation member for cooling the inside of the first housing chamber S1. Specifically, the air that flows into the air introduction port 95 in response to the rotation of the developer roll 21 flows through the first flow passage 91 and the third flow passage 93. The heat within the first housing chamber S1 is transferred via the blade 28 to the air flowing through the third flow passage 93. The blade 28 and the like are cooled thereby and increase in the temperature of the developer can be suppressed.

The air flowing out from the third flow passage 93 is passed to the waste toner box 45 and, after that, discharged to the outside of the waste toner box 45 from the air vent 46.

As the blade 28 is directly cooled by the air in the airflow passage 90, the temperature of the blade 28 and its surroundings can be effectively cooled. The other functions and effects of this example are similar to those of the example shown in FIGS. 2 to 4, discussed above.

Results of Performance Tests

Results of performance evaluation of the aforementioned examples are shown in FIG. 6. In FIG. 6, Test Example 1 is associated with the example developing device shown in FIG. 2, and Test Example 2 is associated with the example developing device shown in FIG. 5. Comparative example 1 is associated with a structure obtained by omitting the airflow passage 90 and the radiation member 85 from the example of FIG. 2, and Comparative example 2 is associated with a structure having the airflow passage 90 similar to that of the example of FIG. 2 but where the radiation member 85 is omitted.

In the tests, temperature, amount of scattered toner, and amount of discharged developer (ADR discharge) were measured under the operating condition of continuous two-sided printing of 14,000 copies at different printing speeds (70 ppm and 80 ppm). The temperature was measured with a thermocouple connected to the blade 28. The amount of scattered toner was determined by recovering, after operation of the developing device, scattered toner attached thereto by suction, and measuring the weight thereof. The amount of discharged developer was determined by recovering, after operation of the developing device, developer discharged from the developer outlet port, and measuring the weight thereof.

In Test Examples 1 and 2, the temperature of the blade 28 was lower, as compared to Comparative examples 1 and 2. This suggests that, in the examples shown in FIG. 2 and FIG. 5, the blade 28 and the like are suitably cooled by the airflow passage 90 and the radiation member 85.

It can be confirmed that, with the constructions having the airflow passage (Test Examples 1 and 2, and Comparative example 2), the amount of scattered toner in the first housing chamber S1 is smaller than that of the construction not having the airflow passage (Comparative example 1). This suggests that the introduction of an airflow generated in the first housing chamber S1 into the airflow passage 90 can suppress increase in the inner pressure of the first housing chamber S1, resulting in the suppression of toner scattering.

It can be confirmed that, with the constructions having the airflow passage (Test Examples 1 and 2, and Comparative example 2), the amount of discharged developer discharged from the developer outlet port 66 is smaller than that of the construction not having the airflow passage (Comparative example 1). This suggests that the introduction of the air drawn into the first housing chamber S1 into the airflow passage 90 can reduce the amount of air leaking to the developer outlet port 66, resulting in the reduction of the amount of the developer discharged with the air from the developer outlet port 66.

As mentioned above, it can be confirmed that, according to the examples, in addition to suppressing increase in the temperature of the blade 28 and developer, the amount of scattered toner and the amount of discharged developer can be effectively reduced.

Relation Between Cross Sectional Area of Airflow Passage and Developer Discharge Amount Provided that the minimum flow passage cross sectional area of the airflow passage 90 is A1 and the opening area of the developer outlet port 66 is A2, FIG. 7 shows the result of a study on a relation between their area ratio (A1/A2) and the amount of discharged developer. It is understood from FIG. 7 that, as the area ratio (A1/A2) increases, the amount of discharged developer decreases. On the other hand, when the area ratio (A1/A2) is made smaller than 5.0, the amount of discharged developer significantly increases. This may be because, when the area ratio (A1/A2) is made large, the amount of air flowing through the developer outlet port 60 is reduced and the amount of the developer entrained and discharged with the airflow is reduced. In view of these, the area ratio may be as high as 5.0 or more, so as to suppress excessive discharge of the developer in the first housing chamber S1 from the developer outlet port 66.

Relation Between Rotation Speed of Developer Roll and Temperature Reduction Effect FIG. 8 shows the result of a study on the degree of decrease in the temperature of the blade 28 in accordance with the rotation speed of the developer roll 21. The amount of temperature reduction in FIG. 8 is a difference obtained by subtracting a temperature measured in the example shown in FIG. 2 (with the airflow passage) from a temperature measured in Comparative example 1 (without the airflow passage), and thus is indicative of the temperature reduction effect of the the example developing device shown in FIG. 2. It is understood from FIG. 8 that, as the rotation speed of the developer roll 21 increases, the amount of temperature reduction increases. This may be because, as the rotation speed of the developer roll 21 increases, the amount of air drawn into the first housing chamber S1 increases, thereby leading to an enhanced radiation effect by the airflow passage 90. In particular, when the rotation speed of the developer roll 21 is in a high-speed area of 500 rpm or more, the amount of temperature reduction ramps up. In view of these, the rotation speed of the developer roll 21 may be as high as 500 rpm or more, so as to enhance the radiation effect by the airflow passage 90.

In another example shown in FIG. 9, a shutter mechanism 98 can open and close the air introduction port 95 of the airflow passage 90. The shutter mechanism 98 may be adapted to be slidable between a position opening the air introduction port 95 and a position closing the same.

The shutter mechanism 98 may be adapted to be switched between open and closed positions, for example, in response to the mounting of the developing device 20 to the image forming apparatus 1. Specifically, upon mounting the developing device 20 to the image forming apparatus 1, the shutter mechanism 98 may operate mechanically to a state of opening the air introduction port 95. In this manner, the air in the first housing chamber S1 can be transferred from the air introduction port 95 to the airflow passage 90, as described above. On the other hand, upon removal of the developing device 20 from the image forming apparatus 1, the shutter mechanism 98 may operate mechanically to a state of closing the air introduction port 95. The shutter mechanism 98 may thereby reliably suppress leakage of the developer from the first housing chamber S1 to the airflow passage 90, during transportation or the like of the removed developing device 20.

The airflow passage 90 may have a structure in which the example first flow passage 91 of FIG. 2 and the example flow passage 93 of FIG. 5 are combined. For example, the structure may be such that part of the air in the first flow passage 91 of the example shown in FIG. 2 is diverted into the third flow passage 93 of the example shown in FIG. 5. With this, the radiation member 85 on the side of the side wall 80 and the blade 28 which also functions as a radiation member both contribute to the cooling of the first housing chamber S1.

It is to be understood that not all aspects, advantages and features described herein may necessarily be achieved by, or included in, any one particular example. Indeed, having described and illustrated various examples herein, it should be apparent that other examples may be modified in arrangement and detail.

LIST OF REFERENCE NUMBERS

20 Developing device; 21 Developer roll; 28 Blade (layer thickness regulating member); 45 Waste toner box; 46 Air vent; 47 Filter; 66 Developer outlet port; 85 Radiation member; 90 Airflow passage; 98 Shutter mechanism; S1 First housing chamber (housing chamber).

The invention claimed is:

1. A developing device comprising:
- a casing containing a housing chamber and having a developer outlet port to discharge developer from the housing chamber;
- a developer roll disposed in the housing chamber, the developer roll to carry a developer;
- a layer thickness regulating member to regulate a thickness of the developer carried by the developer roll;
- an airflow passage to allow air to flow in from the housing chamber when the developer roll rotates;
- a radiation member adjacent the housing chamber to transfer heat to the air flowing through the airflow passage; and
- a waste toner box,
- wherein an outlet end of the airflow passage is connected to the waste toner box.

2. The developing device according to claim 1, wherein the layer thickness regulating member comprises the radiation member.

3. The developing device according to claim 1, wherein the radiation member is also used as the layer thickness regulating member.

4. The developing device according to claim 1, wherein the radiation member has a thermal conductivity of 10 W/mK or more.

5. The developing device according to claim 1, wherein a minimum passage cross sectional area of the airflow passage is five times or more an opening area of the developer outlet port.

6. The developing device according to claim 1, wherein a rotation speed of the developer roll is 500 rpm or more.

7. The developing device according to claim 1, further comprising a shutter located in the airflow passage.

8. The developing device according to claim 1, wherein the waste toner box is to collect developer discharged from the developer outlet port.

9. The developing device according to claim 8, wherein the waste toner box comprises:
- an air vent; and
- a filter.

10. A developing device comprising:
- a casing accommodating a housing chamber;
- a developer roll located in the housing chamber, the developer roll to carry a developer;
- an airflow passage to allow a passage of air from the housing chamber when the developer roll rotates;
- a radiation member located adjacent the housing chamber, to transfer heat from the housing chamber to the airflow passage; and
- a waste toner box,
- wherein an outlet end of the airflow passage is connected to the waste toner box.

11. The developing device according to claim 10, further comprising a layer thickness regulating member to regulate a thickness of the developer carried by the developer roll, wherein the layer thickness regulating member comprises the radiation member.

12. The developing device according to claim 10, wherein the radiation member is located between the housing chamber and the airflow passage.

13. The developing device according to claim 10, wherein the radiation member has a thermal conductivity of 10 W/mK or more.

14. The developing device according to claim 10, wherein the casing comprises a developer outlet port connected to the housing chamber to discharge the developer, and the air flow passage has a minimum cross sectional area that is at least five times an opening area of the developer outlet port.

15. The developing device according to claim 10, further comprising a shutter in the airflow passage to open and close the airflow passage.

16. A developing device comprising:
- a casing having an interior containing a housing chamber and having an air introduction port;
- a first cover member coupled to an exterior of the casing;
- a developer roll located in the housing chamber;
- a first airflow passage to receive air from the housing chamber through the air introduction port when the developer roll rotates; and
- a radiation member to transfer heat from the housing chamber to the first airflow passage,
- wherein the first airflow passage is to allow the air received from the housing chamber to flow between the exterior of the casing and the first cover member.

17. The developing device according to claim 16, further comprising a layer thickness regulating member to regulate a thickness of developer carried by the developer roll, wherein the layer thickness regulating member comprises the radiation member.

18. The developing device according to claim 17, further comprising:

a second cover member coupled to an exterior of the layer thickness regulating member; and a second airflow passage to receive air from the first airflow passage, wherein the second airflow passage is located between the exterior of the layer thickness regulating member and the second cover member.

19. The developing device according to claim 16, further comprising a waste toner box, wherein an outlet end of the first airflow passage is connected to the waste toner box.

20. The developing device according to claim 16, further comprising a shutter located in the first airflow passage.

* * * * *